US008485138B2

(12) United States Patent
Leeland

(10) Patent No.: US 8,485,138 B2
(45) Date of Patent: Jul. 16, 2013

(54) WATER HEATER WITH TEMPORARY CAPACITY INCREASE

(75) Inventor: Shanna Lorraine Leeland, St. Paul, MN (US)

(73) Assignee: Honeywell International Inc., Morristown, NJ (US)

( * ) Notice: Subject to any disclaimer, the term of this patent is extended or adjusted under 35 U.S.C. 154(b) by 1280 days.

(21) Appl. No.: 12/270,783

(22) Filed: Nov. 13, 2008

(65) Prior Publication Data

US 2010/0116224 A1 May 13, 2010

(51) Int. Cl.
*F24H 9/20* (2006.01)

(52) U.S. Cl.
USPC ..... 122/14.22; 122/14.21; 700/300

(58) Field of Classification Search
USPC ..... 122/14.1, 14.2, 14.21, 14.22; 700/299, 700/300; 236/51
See application file for complete search history.

(56) References Cited

U.S. PATENT DOCUMENTS

| | | | |
|---|---|---|---|
| 3,847,350 | A | 11/1974 | Thompson |
| 3,849,350 | A | 11/1974 | Matsko |
| 4,324,944 | A | 4/1982 | Weihrich et al. |
| RE30,936 | E | 5/1982 | Kmetz et al. |
| 4,333,002 | A | 6/1982 | Kozak |
| 4,467,178 | A | 8/1984 | Swindle |
| 4,508,261 | A | 4/1985 | Blank |
| 4,511,790 | A | 4/1985 | Kozak |
| 4,568,821 | A | 2/1986 | Boe |
| 4,588,875 | A | 5/1986 | Kozak et al. |
| 4,692,598 | A | 9/1987 | Yoshida et al. |
| 4,696,639 | A | 9/1987 | Bohan, Jr. |
| 4,734,658 | A | 3/1988 | Bohan, Jr. |
| 4,742,210 | A | 5/1988 | Tsuchiyama et al. |
| 4,770,629 | A | 9/1988 | Bohan, Jr. |
| 4,834,284 | A | 5/1989 | Vandermeyden |
| 4,984,981 | A | 1/1991 | Pottebaum |
| 4,986,468 | A | 1/1991 | Deisinger |
| 5,007,156 | A | 4/1991 | Hurtgen |
| 5,103,078 | A | 4/1992 | Boykin et al. |
| 5,442,157 | A | 8/1995 | Jackson |
| 5,622,200 | A | 4/1997 | Schulze |
| 5,660,328 | A | 8/1997 | Momber |

(Continued)

FOREIGN PATENT DOCUMENTS

| | | |
|---|---|---|
| EP | 0356609 | 3/1990 |
| EP | 0699316 | 7/1999 |

(Continued)

OTHER PUBLICATIONS

U.S. Appl. No. 10/911,151, filed Aug. 3, 2004.

(Continued)

*Primary Examiner* — John K Fristoe, Jr.
*Assistant Examiner* — Matthew W Jellett
(74) *Attorney, Agent, or Firm* — Seager Tufte & Wickhem LLC.

(57) ABSTRACT

A water heater may be configured to temporarily increase its hot water capacity by heating water to a higher boost temperature. In some instances, the water heater may include a main controller that can accept a boost request from a remote controller, and thus may temporarily provide additional hot water capacity without, for example, requiring a homeowner to go down to the basement, out to the garage, or wherever the water heater happens to be to make manual adjustments to the water heater settings.

17 Claims, 6 Drawing Sheets

U.S. PATENT DOCUMENTS

| | | | |
|---|---|---|---|
| 5,779,143 | A | 7/1998 | Michaud et al. |
| 5,797,358 | A | 8/1998 | Brandt et al. |
| 5,896,089 | A | 4/1999 | Bowles |
| 5,968,393 | A | 10/1999 | Demaline |
| 5,975,884 | A | 11/1999 | Dugger |
| 6,053,130 | A | 4/2000 | Shellenberger |
| 6,059,195 | A | 5/2000 | Adams et al. |
| 6,069,998 | A | 5/2000 | Barnes et al. |
| 6,075,923 | A | 6/2000 | Wu |
| 6,208,806 | B1 | 3/2001 | Langford |
| 6,212,894 | B1 | 4/2001 | Brown et al. |
| 6,261,087 | B1 | 7/2001 | Bird et al. |
| 6,271,505 | B1 | 8/2001 | Henderson |
| 6,293,471 | B1 | 9/2001 | Stettin et al. |
| 6,350,967 | B1 | 2/2002 | Scott |
| 6,363,218 | B1 | 3/2002 | Lowenstein et al. |
| 6,375,087 | B1 | 4/2002 | Day et al. |
| RE37,745 | E | 6/2002 | Brandt et al. |
| 6,560,409 | B2 | 5/2003 | Troost, IV |
| 6,633,726 | B2 | 10/2003 | Bradenbaugh |
| 6,701,874 | B1 | 3/2004 | Schultz et al. |
| 6,795,644 | B2 | 9/2004 | Bradenbaugh |
| 6,861,621 | B2 | 3/2005 | Ghent |
| 6,880,493 | B2 | 4/2005 | Clifford |
| 6,934,862 | B2 | 8/2005 | Sharood et al. |
| 6,936,798 | B2 | 8/2005 | Moreno |
| 6,955,301 | B2 | 10/2005 | Munsterhuis et al. |
| 6,959,876 | B2 | 11/2005 | Chian et al. |
| 7,088,238 | B2 | 8/2006 | Karaoguz et al. |
| 7,117,825 | B2 | 10/2006 | Phillips |
| 7,221,862 | B1 | 5/2007 | Miller et al. |
| 7,252,502 | B2 | 8/2007 | Munsterhuis |
| 7,317,265 | B2 | 1/2008 | Chian et al. |
| 8,165,726 | B2 * | 4/2012 | Nordberg et al. ..... 700/300 |
| 8,176,881 | B2 * | 5/2012 | Arensmeier et al. ..... 122/14.22 |
| 2004/0042772 | A1 | 3/2004 | Whitford et al. |
| 2004/0267385 | A1 | 12/2004 | Lingemann |
| 2005/0077368 | A1 | 4/2005 | Zak et al. |
| 2005/0147401 | A1 | 7/2005 | Baxter |
| 2005/0147402 | A1 | 7/2005 | Baxter |
| 2005/0150967 | A1 | 7/2005 | Chapman, Jr. et al. |
| 2006/0243816 | A1 | 11/2006 | Teti |
| 2007/0023333 | A1 | 2/2007 | Mouhebaty et al. |
| 2007/0034169 | A1 | 2/2007 | Phillips |
| 2007/0191994 | A1 | 8/2007 | Patterson et al. |
| 2007/0246551 | A1 | 10/2007 | Phillips et al. |
| 2007/0295823 | A1 | 12/2007 | Yamada et al. |
| 2008/0023564 | A1 | 1/2008 | Hall |
| 2008/0188995 | A1 | 8/2008 | Hotton et al. |
| 2009/0139466 | A1 * | 6/2009 | Takayama ..... 122/14.2 |
| 2010/0206869 | A1 * | 8/2010 | Nelson et al. ..... 219/494 |

FOREIGN PATENT DOCUMENTS

| | | |
|---|---|---|
| GB | 2211331 | 6/1999 |
| JP | 8264469 | 10/1996 |
| JP | 2008008548 | 1/2008 |

OTHER PUBLICATIONS

Lennox, "Network Control Panel, User's Manual," 18 pages, Nov. 1999.

Moog, "M3000 Control System, RTEMP 8, Remote 8-Channel Temperature Controller with CanOpen Interface," 6 pages, Nov. 2004.

* cited by examiner

WATER HEATER WITH TEMPORARY CAPACITY INCREASE

TECHNICAL FIELD

This disclosure relates generally to water heaters and more particularly to water heaters that are configured to provide a temporary capacity increase.

BACKGROUND

Water heaters are commonly used in homes, businesses and just about any establishment having the need for heated water. In many cases, a water heater is configured to heat water in a water heater tank using a gas-fired burner, an electric heater or some other heater element. When demand for hot water arises (e.g., someone turns on a faucet to run a shower), fresh, cold or ambient temperature water typically enters the water heater tank and "pushes out" or supplies the hotter water. When the temperature of the water in the water heater falls below a temperature set point, either though the mere passage of time or as a result of a hot water draw, the water heater typically activates a heater element to restore the temperature of the water in the tank back to the temperature set point.

To help reduce cycling of the water heater, a temperature differential is often employed, where the water heater does not activate the heater element until the temperature of the water in the water heater falls below the temperature set point by at least a temperature differential amount. The desired temperature set point can be referred to as the first temperature set point and the temperature at which the heater element is actually activated can be referred to as the second temperature set point, where the difference between the first temperature set point and the second temperature set point corresponds to the temperature differential.

A conventional water heater typically has at least one heating element or "heater," such as a gas-fired and/or electric burner. To take advantage of the "heat-rises" principle, the heater is often located at or near the bottom of the water heater tank. Each water heater typically also has at least one thermostat or controller for controlling the heater. To facilitate the heating of water, the controller often receives signals related to the temperature of the water, oftentimes from a temperature sensor that is thermally engaged with the water within the water heater. When temperature signals from the temperature sensor indicate that the water temperature is below the second temperature set point, for example when the water temperature is below about 120° F., the controller may turn on the heater element and the water within the water heater begins to heat. After some time, the water temperature within the water heater tank may increase back to the first temperature set point, which, for example, may be about 140° F. At this point, the controller may cause the heater element to reduce its heat output or, alternatively, causes the heater element to turn off. This heating cycle may begin again when the water temperature within the water heater tank drops below the second temperature set point.

Water heaters are typically available in a variety of different sizes so that a particular home or building may be equipped with a water heater having a thermal capacity, or quantity of sufficiently heated water, that is sufficient for normal conditions expected for the particular home or building. However, special circumstances, such as having overnight visitors, may mean that there may be a temporary, larger than normal demand for hot water. Typically, the increased demand is accompanied by a need to have increased hot water available within a relatively short time frame. For example, several extra house guests may wish to shower in the morning, causing a temporary increased demand for hot water in a relatively short time period. One way to accommodate this situation is to initially install an oversized water heater. However, it may not be very efficient to run an oversized water heater all the time to accommodate occasional and short-term demands for increased hot water.

SUMMARY

The present disclosure relates generally to water heaters and more particularly to water heaters that are configured to provide a temporary hot water capacity increase. In one illustrative embodiment, this may be accomplished by temporarily increasing the temperature of the water in the water heater tank. In some instances, the water heater may include a main controller that can accept a boost request from a remote controller or the like, and in response, may temporarily increase the temperature of the water in the water heater tank to provide additional hot water without requiring a user to, for example, go down to the basement, out to the garage, or wherever the water heater happens to be to manually and temporarily change the set point of the water heater.

In an illustrative but non-limiting example, a water heater is provided that includes a water tank and a heat source that is disposed proximate the water tank. A main controller may be provided that is configured to control the heat source. The main controller may include a maximum temperature set point and an operating temperature set point, and may operate in accordance with a particular temperature differential as described above. In some cases, a remote controller may be configured to accept a request, such as from a homeowner or other user, for additional hot water capacity and may communicate a resultant boost request to the main controller. In some instances, the boost request may include instructions to increase to a boost temperature set point that is higher than the normal operating temperature set point. In some cases, the temperature differential temperature may be reduced while in the boost mode.

Another illustrative but non-limiting example of the disclosure may be found in a water heater that includes a water tank and a gas burner that is disposed proximate the water tank. A communicating gas valve may be configured to control gas flow to the gas burner. The communicating gas valve may include a maximum temperature set point and an operating temperature set point and may operate in accordance with a particular temperature differential as described above. In some cases, a remote controller may be configured to accept a request for additional hot water capacity from a user, and to communicate a resultant boost request to the communicating gas valve. In some instances, the boost request may include instructions to increase to a boost temperature set point that is higher than the normal operating temperature set point. In some cases, the temperature differential temperature may be reduced while in the boost mode.

Another illustrative but non-limiting example of the disclosure may be found in a method of operating a water heater that has a communicating gas valve having a main controller and a remote controller. A maximum temperature set point may be provided, as well as operating temperature set point. The main controller may operate the water heater in accordance with the operating temperature set point. If a boost request is accepted from the remote controller, the main controller may temporarily operate the water heater in accordance with a boost temperature set point. In some cases, the temperature differential temperature may be reduced while in the boost mode.

The above summary is not intended to describe each and every disclosed embodiment or every implementation of the disclosure. The Description that follows more particularly exemplifies various illustrative embodiments.

BRIEF DESCRIPTION OF THE FIGURES

The following description should be read with reference to the drawings. The drawings, which are not necessarily to scale, depict selected embodiments and are not intended to limit the scope of the disclosure. The disclosure may be more completely understood in consideration of the following detailed description of various embodiments in connection with the accompanying drawings, in which.

Figure 1:
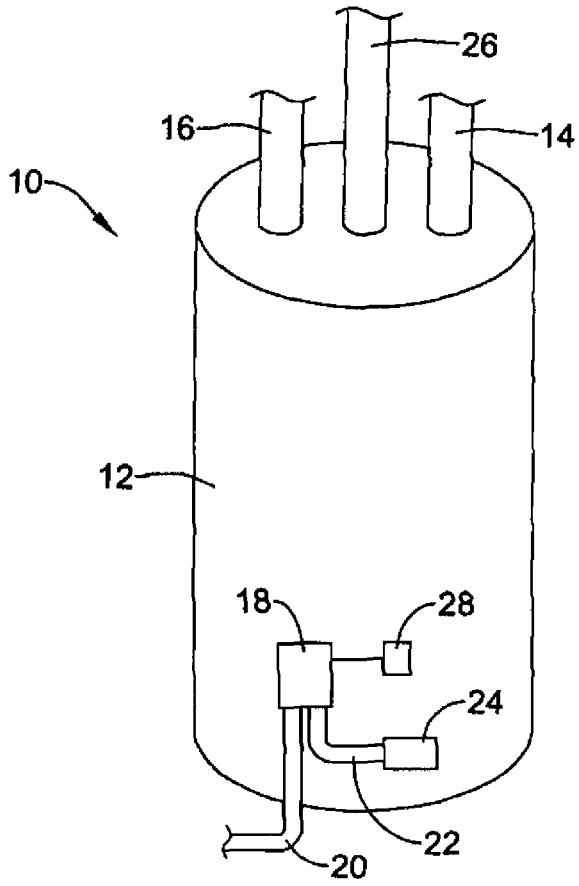
FIG. 1 is a schematic view of an illustrative but non-limiting water heater in accordance with the present disclosure.

While the invention is amenable to various modifications and alternative forms, specifics thereof have been shown by way of example in the drawings and will be described in detail. It should be understood, however, that the intention is not to limit the invention to the particular illustrative embodiments described. On the contrary, the intention is to cover all modifications, equivalents, and alternatives falling within the spirit and scope of the invention.

DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

The disclosure relates to heating water, and as such may include fossil fuel-fired water heaters, electrically heated water heaters, boilers and the like. Merely for illustrative purposes, the drawings show a fossil fuel-fired water heater. However, it is contemplated that the any type of water heater may be used.

FIG. 1 shows a schematic view of an illustrative but non-limiting water heater 10. Water heater 10 includes a water tank 12. Cold water enters water tank 12 through a cold water line 14 and is heated by a gas burner 24. The resulting heated water exits through a hot water line 16. A gas control unit 18 regulates gas flow from a gas source 20 through a combustion gas line 22 and into gas burner 24. A flue 26 permits combustion byproducts to safely exit. Water heater 10 may include a temperature sensor 28. In some cases, temperature sensor 28 may enter water tank 12 at a location exterior to gas control unit 18. In some instances, however, temperature sensor 28 may instead be located behind gas control unit 18. To accommodate this, water tank 12 may include an aperture or recess (not illustrated) that is sized and configured to accept temperature sensor 28.

Figure 2:
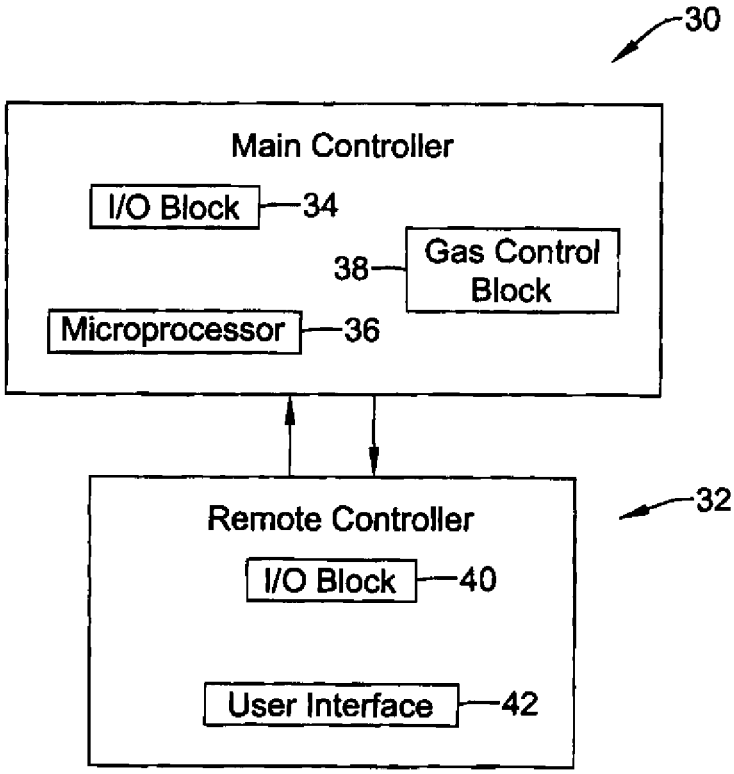
FIG. 2 is a schematic block view of an illustrative control system that may be used with the water heater of FIG. 1.

In some cases, gas control unit 18 may be in communication with a main controller (not seen in FIG. 1) that provides gas control unit 18 with appropriate command instructions. In some cases, gas control unit 18 may itself incorporate the main controller. FIG. 2 is a schematic diagram showing how a remote controller may provide instructions to gas control unit 18. FIG. 2 shows a main controller 30 and a remote controller 32 that is in communication with main controller 30. In some cases, remote controller 32 may communicate wirelessly with main controller 30. In some instances, remote controller 32 may be electrically connected to main controller 30 via wires such as low voltage wiring, similar to the 24 volt wiring used to connect HVAC thermostats to furnaces and other HVAC equipment. These are only example connections that may facilitate communication between the main controller 30 and the remote controller 32.

As noted above, and in some instances, main controller 30 may be integrated into gas control unit 18, while in other cases main controller 30 may be external to gas control unit 18 but in communication with gas control unit 18. It is contemplated that main controller 30 may have several components. In some cases, main controller 30 may have an I/O block 34 that accepts signals from a temperature sensor 28 (FIG. 1), remote controller 32 and/or any other suitable device or component. I/O block 34 may accommodate control signals from remote controller 32. Main controller 30 may include a microprocessor 36 that may be configured to accept appropriate signals from I/O block 34 and determine appropriate output signals that can be outputted via I/O block 34 to other components within gas control unit 18 (FIG. 1), remote controller 32 and/or any other suitable device or component. While not illustrated, microprocessor 36 may also include memory.

In some cases, main controller 30 may also include a Gas Control block 38. Gas Control block 38 may receive command instructions from microprocessor 36 and may in turn provide appropriate instructions to an electrically controlled gas valve disposed within or controlled by the gas control unit 18.

The illustrative remote controller 32 may also have several components. In some instances, remote controller 32 may include an I/O block 40 and a user interface 42. I/O block 40 may, for example, receive information from the user interface 42 and provide corresponding information to main controller 30. When provided, user interface 42 may take any desired form, and may include a display and/or one or more buttons that a user may use to enter information.

In some instances, user interface 42 may be configured to permit a user to request additional hot water. For example, a homeowner may anticipate that due to a larger number of occupants, hot water may run low at a particular time of day. In some cases, the homeowner may preemptively instruct water heater 10 (FIG. 1) to provide additional hot water capacity to remedy the expected shortcoming via user interface 42. It is contemplated that remote controller 32 may be configured to permit a homeowner or other user to make a request for additional hot water capacity for a particular period of time. In other cases, it is contemplated that remote controller 32 may be programmed to provide additional hot water capacity on a regular or programmed basis, perhaps at a particular time of day and/or only on certain day(s).

Figure 3:
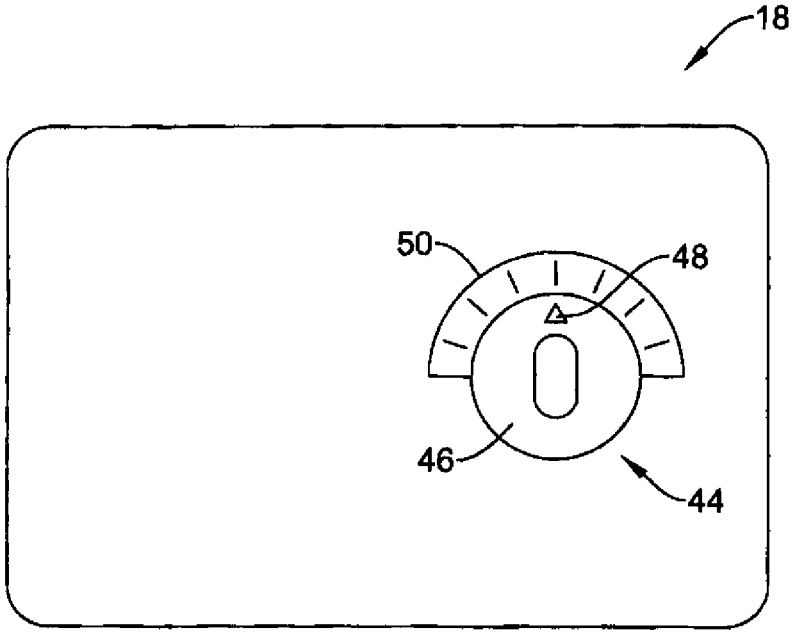
FIG. 3 is a schematic view of an illustrative main controller that may be used in the control system of FIG. 2.

Turning now to FIG. 3, an illustrative but non-limiting example of gas control unit 18 is shown. Gas control unit 18 may include a temperature set point setting device 44. In some instances, temperature set point setting device 44 may include a rotatable knob 46 having an indicator line or arrow 48. The rotatable knob 46 may rotate relative to a temperature scale 50 that is printed or otherwise disposed on an outer surface of gas control unit 18. In some cases, temperature set point setting device 44 may provide gas control unit 18 with an operating temperature set point. In some instances, particularly if gas control unit 18 is in communication with a remote controller such as remote controller 32 (FIG. 2), temperature set point setting device 44 may provide gas control unit 18 with a maximum temperature set point, while the remote controller may provide the operating temperature set point. In some instances, both an operating temperature set point and a maximum temperature set point may be set using one or more dials or the like at the gas control unit 18. While a rotating knob 46 is shown, it is contemplated that any suitable user interface may be provided for setting an operating temperature set point and/or a maximum temperature set point, as desired.

Figure 4:
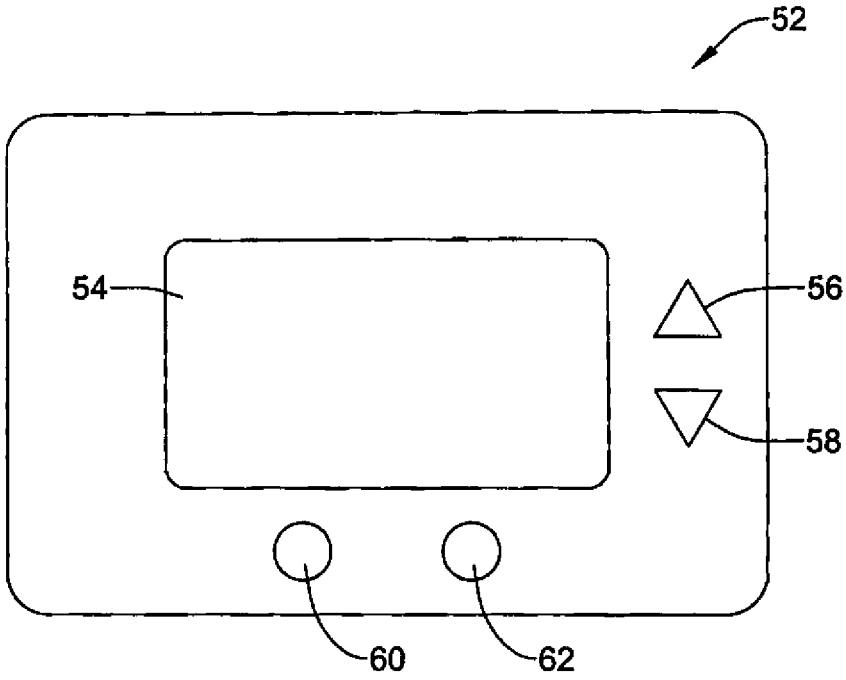
FIG. 4 is a schematic view of an illustrative remote controller that may be used in the control system of FIG. 2.

FIG. 4 shows an illustrative but non-limiting example of a remote controller 52 that may be considered as being an illustrative embodiment of remote controller 32 (FIG. 2). Remote controller 52 may be mounted or otherwise disposed within a home or building, at a location that is remote from water heater 10 (FIG. 1). In some cases, for example, remote controller 52 may be wall-mounted within a living space, proximate or incorporated into a HVAC controller such as a thermostat. In some instances, it is contemplated that remote controller 52 may be disposed in or near a bathroom, as a bath or shower is often a large consumer of hot water.

Regardless of where remote controller 52 is disposed, illustrative remote controller 52 may include one or more of a display 54, an UP arrow 56, a DOWN arrow 58, and/or selection buttons 60 and 62. In some cases, it is contemplated that display 54 may be a touch screen display such as a touch screen LCD display, and as such, remote controller 52 may not include any physical buttons. In some instances, for example, display 54 may provide a graphical representation of an operating temperature set point, the current status of water heater 10 (FIG. 1), i.e., whether water heater 10 is in a draw period, recovery period or standby, or any other desired information. In some cases, display 54 may provide an indication of whether or not water heater 10 is in a boost mode period. A boost mode period is a time period during which a user has requested, sometimes via remote controller 52, an elevated water temperature within water heater 10 in order to obtain more thermal energy from water heater 10 than may otherwise be available when operating at the operating temperature set point.

In some cases, UP arrow 56 and/or DOWN arrow 58 may be used by the user to raise or lower an operating temperature set point. In some instances, remote controller 52 may accept an operating temperature set point from a user and may communicate the operating temperature set point to main controller 30 (FIG. 2). Main controller 30 may then operate water heater 10 in accordance with the operating temperature set point provided by the remote controller 52, provided that certain safety parameters are met. For example, main controller 30 (FIG. 2) may operate in accordance with the operating temperature set point as long as the operating temperature set point does not exceed a predetermined temperature safety limit such as 160° F., or perhaps 154° F. In some cases, main controller 30 may operate in accordance with the operating temperature set point as long as the operating temperature set point provided by remote controller 52 does not exceed the maximum temperature set point set by temperature set point setting device 44 (FIG. 3). In some cases, the operating temperature set point is set at the main controller 30, and not via the remote controller 32.

Under normal operating conditions, main controller 30 may operate water heater 10 (FIG. 1) in accordance with a particular temperature differential value. The temperature differential may be a numerical difference between a temperature at which gas burner 24 is activated and a temperature at which gas burner 24 is terminated or stopped. For example, if main controller 30 is programmed with a temperature differential value of say 10° F. and a temperature set point of 120° F., gas burner 24 may be activated when a water temperature indicated by temperature sensor 28 (FIG. 1) falls to 110° F., and may run until the water temperature rises to 120° F. However, in some illustrative embodiments, if a homeowner or other user requests additional hot water via remote controller 32 (FIG. 2) or otherwise, main controller 30 may operate using a lower temperature differential or even a zero differential, if desired.

In an illustrative embodiment, when remote controller 32 (FIG. 2) instructs main controller 30 (FIG. 2) that additional hot water capacity has been requested, main controller 30 may determine a boost temperature set point that may represent an increase to the operating temperature set point. For example, the boost temperature set point may be 10° F. higher than the operating temperature set point, but it will be appreciated that other temperature increases may also be employed. In some instances, the boost temperature set point may be limited by safety limits and/or by the maximum temperature set point set by, for example, the temperature set point setting device 44 (FIG. 3).

In some embodiments, main controller 30 (FIG. 2), upon receiving a boost request from remote controller 32 (FIG. 2), may operate gas burner 24 (FIG. 1) until the boost temperature set point has been reached. Once the boost temperature set point has been reached, the boost period may be ended and main controller 30 may in some cases revert back to the normal operating temperature set point. In some cases, main controller 30 may operate in accordance with the boost temperature set point, turning gas burner 24 on and off as appropriate to maintain the water at the boost temperature set point for a predetermined length of time. For example, main controller 30 may maintain the boost temperature set point for a period of time up to about 2 hours, although other time periods are contemplated and permissible. In some cases, main controller 30 may maintain the boost temperature set point indefinitely, until receiving a subsequent signal from remote controller 32 (FIG. 2) to return to the operating temperature set point. When operating in accordance with the boost temperature set point, the water heater 10 may operate normally but with a higher temperature set point and thus attempts to heat all of the water in the water tank, and not just water around a top portion of the tank. This can significantly increase the hot water capacity of the water heater 10 during a boost period.

Figure 5:
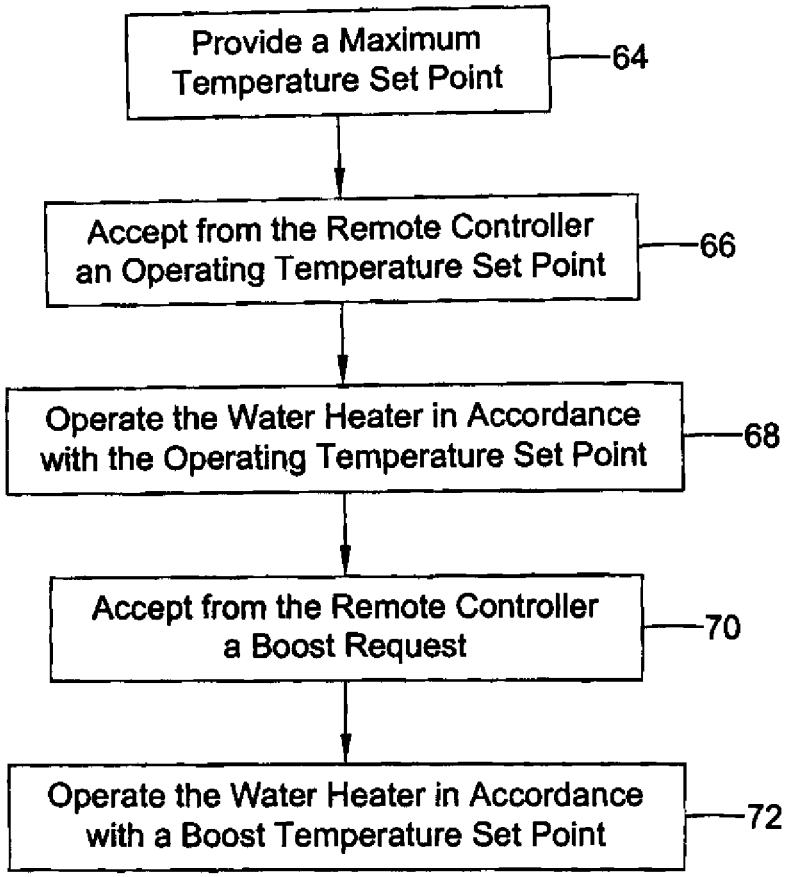
FIG. 5 is a flow diagram showing an illustrative but non-limiting example of a method that may be carried out via the control system of FIG. 2.

FIG. 5 is a flow diagram showing an illustrative but non-limiting example of a method that may be carried out in the operation of water heater 10 (FIG. 1). Control begins at block 64, where a maximum temperature set point is provided. In some cases, this may be done using temperature set point setting device 44 (FIG. 3) or though some other user interface. Alternatively, or in addition, a maximum temperature set point may be hard coded. At block 66, an operating temperature set point may be accepted, such as from the remote controller 32 (FIG. 2) or through a dial or the like on the main controller 30. Main controller 30 (FIG. 2) may operate water heater 10 in accordance with the operating temperature set point, as shown at block 68.

Control passes to block 70, where a boost request is accepted from, for example, the remote controller 32 (FIG. 2). In some cases, main controller 30 (FIG. 2) may calculate or otherwise determine a boost temperature set point, and may operate water heater 10 (FIG. 1) in accordance with the boost temperature set point as shown at block 72. In some instances, water heater 10 (FIG. 1) may be operated in accordance with the boost temperature set point for a predetermined length of time, and sometimes set the temperature differential to zero or any other desired temperature differential. Reducing the temperature differential to zero may cause the main controller 30 to immediately activate the heater element of the water heater. In some cases, water heater 10 may be operated in accordance with a boost temperature set point only if the boost temperature set point falls below particular safety limits and/or below the maximum temperature set at block 64. In some cases, the main controller 30 may adjust the boost temperature set point to be within particular safety limits and/or within the maximum temperature set at block 64.

Figure 6:
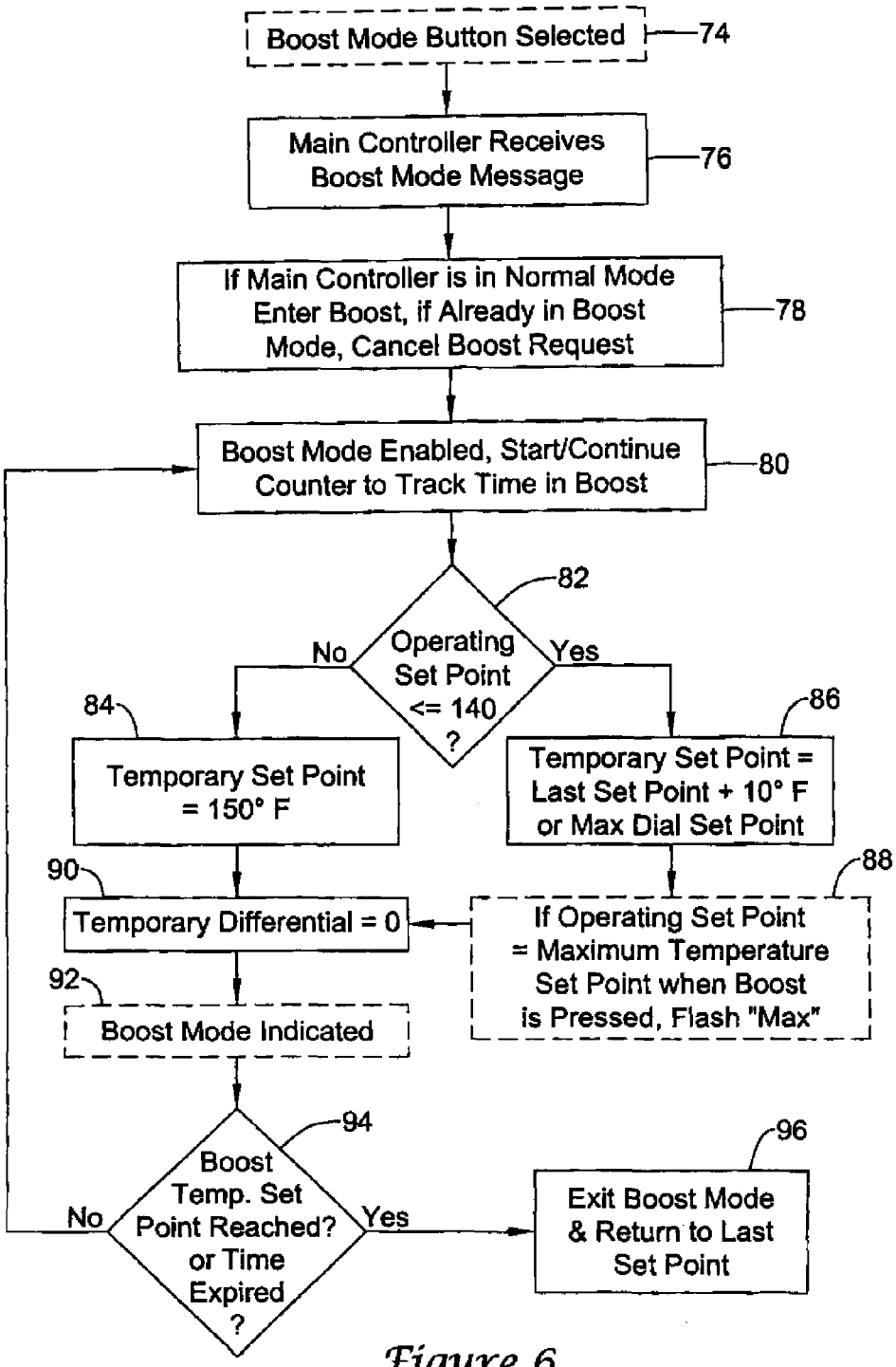
FIG. 6 is a flow diagram showing an illustrative but non-limiting example of a method that may be carried out via the control system of FIG. 2.

FIG. 6 is a flow diagram showing another illustrative but non-limiting example of a method that may be carried out in the operation of water heater 10 (FIG. 1). In FIG. 6, it can be seen that certain steps or operations, indicated by solid lines, may be manifested within main controller 30 (FIG. 2), while other steps or operations, indicated by dashed lines, may be manifested within remote controller 32, but this is not required. At block 74, it can be seen that a homeowner or other user has pressed a Boost button or otherwise activated a boost mode via remote controller 32 (FIG. 2). A boost button may, for example, correspond to one of the selection buttons 60 or 62 shown on remote controller 52 (FIG. 4), or may be a touch button on a touch screen display. At block 76, main controller 30 receives the boost request.

Control passes to block 78, where if main controller 30 (FIG. 2) is operating in accordance with an operating temperature set point, main controller 30 enters a boost mode. If main controller 30 is already in boost mode when the Boost button is pushed, the main controller may cancel the boost mode, return to operating in accordance with an operating temperature set point, and return to block 74.

At block 80, main controller 30 enables the boost mode. In some cases, main controller 30 may also start a counter or timer that can be used to set a maximum time period for the boost mode. Control is then passed to decision block 82. At decision block 82, a determination is made whether the normal operating temperature set point is at or below 140° F. (where 140° F. is selected for illustrative purposes only). If the operating temperature set point is less than or equal to 140° F. at decision block 82, control passes to block 86 where a boost temperature set point is set equal to the normal operating temperature set point plus 10° F. (where 10° F. is selected for illustrative purposes only) or the maximum temperature set point, whichever is less. Control then passes to block 88, where the operating temperature set point is compared to the maximum temperature set point. If the operating temperature set point is already equal to the maximum temperature set point when the boost button is pressed, remote controller 32 (FIG. 2) may provide a graphical or other indication of this condition (such as flash "MAX"), telling the user that no boost is available because the water heater 10 (FIG. 1) is already operating at the maximum temperature set point. In some cases, this may cause the user to adjust the maximum temperature set point using, for example, temperature set point setting device 44 (FIG. 3). It is contemplated that this determination, and a corresponding display such as that shown at block 88, may also take place even if, at decision block 82, the normal operating temperature set point was greater than 140°.

Returning back to decision block 82, if the normal operating temperature set point is greater than 140° F., control passes to block 84 where the boost temperature set point is set equal to 150° F. That is, if the normal operating temperature set point is greater than 140° F., the boost temperature set point is not increased by 10° F., but rather is only raised to 150° F.

From blocks 84 and 88, control is passed to block 90. In block 90, main controller 30 (FIG. 2) may temporarily set the temperature differential equal to zero or some other reduced value as desired. This may trigger operation of gas burner 24 (FIG. 1) sooner than it would otherwise be started, thereby initiating the heating cycle sooner. At block 92, remote controller 32 (FIG. 2) may provide a graphical or other indication that water heater 10 (FIG. 1) is in a boost mode. Control is then passed to block 94, where main controller 30 determines if the boost temperature set point has been reached, or if the timer started in block 80 has expired. In the illustrative embodiment, if either event has occurred, control passes to block 96 where the main controller 30 exits the boost mode and returns to operating at the operating temperature set point. If the boost temperature set point has not been reached and if the timer started in block 80 has not expired, control reverts to block 80, where the timer is continued.

In some cases, the main controller 30 may include an anti-stacking control algorithm to help prevent stacking in the water tank, such as described in U.S. Pat. No. 6,560,409 and 6,955,301, which are incorporated herein by reference.

The disclosure should not be considered limited to the particular examples described above, but rather should be understood to cover all aspects of the invention as set out in the attached claims. Various modifications, equivalent processes, as well as numerous structures to which the invention can be applicable will be readily apparent to those of skill in the art upon review of the instant specification.

What is claimed is:

1. A water heater system comprising:

a water tank;

a heat source disposed proximate the water tank;

a main controller disposed proximate the water tank, the main controller configured to control the heat source, the main controller including a maximum temperature set point and an operating temperature set point, the main controller operating in accordance with a particular temperature differential; and a remote controller in communication with the main controller and configured to accept a request from a user for additional hot water capacity, resulting in the remote controller communicating a boost request to the main controller, wherein the boost request results in the main controller temporarily operating in accordance with a boost temperature set point that is higher than the operating temperature set point;

wherein the main controller, upon receiving the boost request from the user, activates a timer and operates the heat source in accordance with the boost temperature set point for a predetermined length of time measured by the timer; and wherein the main controller sets the boost temperature set point at a temperature that is a predetermined amount above the operating temperature set point as long as the resulting boost temperature set point does not exceed the maximum temperature set point of the main controller.

2. The water heater system of claim 1, wherein the heat source includes a fossil fuel burner and the main controller is included in a communicating gas valve.

3. The water heater system of claim 1, wherein the remote controller is configured to accept an operating temperature set point, and to communicate the operating temperature set point to the main controller.

4. The water heater system of claim 1, wherein the main controller, upon receiving the boost request, operates the heat source until the boost temperature set point is reached and is controlled to for the predetermined length of time.

5. The water heater system of claim 1, wherein the main controller, upon receiving the boost request, operates the heat source for the predetermined length of time unless a subsequent signal to stop the boost request is received from a user via the remote controller.

6. A water heater system comprising:

a water tank;

a gas burner disposed proximate the water tank;

a communicating gas valve configured to control gas flow to the gas burner, the communicating gas valve including a controller with a maximum temperature set point and an operating temperature set point, the controller of the communicating gas valve operating in accordance with a particular temperature differential; and a remote controller configured to accept a request for additional hot water from a user and to communicate a resultant boost request to the controller of the communicating gas valve, wherein in response, the controller of the communicating gas valve operates in accordance with a boost temperature set point that is higher than the operating temperature set point;

wherein upon accepting a request for additional hot water from a user, the controller of the communicating gas valve initiates a timer and operates in accordance with the boost temperature set point for a predetermined length of time as determined by the timer; and wherein, the communicating gas valve, in response to receiving the boost request from the remote controller, sets the boost temperature set point at a temperature that is a predetermined amount above the operating temperature set point.

7. The system of claim 1, wherein the main controller is configured to:

compare the boost temperature set point to the maximum temperature set point; and set the boost temperature set point to the maximum temperature set point if the boost temperature set point is higher than the maximum temperature set point.

8. The water heater system of claim 6, wherein the communicating gas valve may, in response to receiving the boost request from the remote controller, reduce the temperature differential and thus provide gas to the gas burner sooner.

9. The water heater system of claim 6, wherein the communicating gas valve sets the boost temperature set point at a temperature that is a predetermined amount above the operating temperature set point limited by the maximum temperature set point.

10. The water heater system of claim 6, wherein the remote controller provides the controller of the communicating gas valve with the operating temperature set.

11. The water heater system of claim 6, wherein the communicating gas valve, upon receiving the boost request, provides gas to the gas burner until the boost temperature set point is reached and is to for the predetermined length of time.

12. The water heater system of claim 6, wherein the communicating gas valve, upon receiving the boost request, provides gas to the gas burner for the predetermined length of time.

13. The water heater system of claim 6, wherein the communicating gas valve, upon receiving the boost request, provides gas to the gas burner for the predetermined length of time unless a subsequent signal to stop the boost request is received from a user via the remote controller.

14. A method of operating a water heater having a communicating gas valve and a remote controller, the method comprising the steps of:

storing a maximum temperature set point and an operating temperature set point;

operating the water heater in accordance with the operating temperature set point;

accepting from the remote controller a boost request for additional hot water capacity;

setting the boost temperature set point to the operating temperature set point plus an offset limited by the maximum temperature set point;

activating a timer;

temporarily operating the water heater in accordance with a boost temperature set point for a predetermined time period as determined by the timer after the boost request for additional hot water capacity is accepted; and returning to operate the water heater in accordance with the operating temperature set point after the predetermined time period expires.

15. The method of claim 14, wherein operating the water heater in accordance with the boost temperature set point includes operating the water heater with a reduced temperature differential.

16. The method of claim 14 wherein the operating temperature set point is accepted from the remote controller.

17. The method of claim 14, further comprising:

comparing the operating temperature set point plus the offset to the maximum temperature set point; and setting the boost temperature set point to the maximum temperature set point if the operating temperature set point plus the offset is higher than the maximum temperature set point.

* * * * *